US007898560B2

(12) United States Patent
Naito

(10) Patent No.: US 7,898,560 B2
(45) Date of Patent: Mar. 1, 2011

(54) PRINTER

(75) Inventor: Tadahiro Naito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 1172 days.

(21) Appl. No.: 11/490,015

(22) Filed: Jul. 21, 2006

(65) Prior Publication Data

US 2007/0035610 A1 Feb. 15, 2007

(30) Foreign Application Priority Data

Aug. 9, 2005 (JP) ..... 2005-231333

(51) Int. Cl.
*B41J 2/32* (2006.01)

(52) U.S. Cl. ..... 347/171

(58) Field of Classification Search ..... 347/171, 347/172, 177, 183, 184, 198, 200, 215, 217–218, 347/220–221
See application file for complete search history.

(56) References Cited

U.S. PATENT DOCUMENTS 5,610,649 A 3/1997 Kokubo
5,680,168 A 10/1997 Kokubo et al.
5,699,100 A 12/1997 Fukuda et al.
6,219,078 B1 4/2001 Sawano
7,365,760 B2 * 4/2008 Katsuma et al. ..... 347/200

FOREIGN PATENT DOCUMENTS

JP 56-161182 A 12/1981
JP 62-208975 A 9/1987
JP 2-11347 A 1/1990
JP 4-250075 A 9/1992
JP 7-214805 A 8/1995
JP 9-216398 A 8/1997
JP 3109386 B2 9/2000

OTHER PUBLICATIONS

European Search Report dated Sep. 22, 2009 (six (6) pages).
Japanese Office Action dated Oct. 19, 2010 including English translation (Three (3) pages).

* cited by examiner

*Primary Examiner* — K. Feggins
(74) *Attorney, Agent, or Firm* — Crowell & Moring LLP

(57) ABSTRACT

A printer capable of reducing a time for increasing the temperature of a heating element to a proper level for starting printing beforehand and suppressing density reduction in an initial stage of printing is obtained. This printer comprises a print head having a heating element for printing an image on a paper, a platen roller against which the print head is pressed through an ink sheet and the paper and print head control means applying a prescribed voltage to the heating element of the print head while carrying the paper after pressing the print head against the platen roller and before starting printing.

6 Claims, 10 Drawing Sheets

PRINTER

BACKGROUND OF THE INVENTION

1. Field of the Invention

The present invention relates to a printer, and more particularly, it relates to a printer comprising a print head.

2. Description of the Background Art

In relation to a printer such as a thermal transfer printer, various structures are generally proposed in order to suppress reduction of print density by applying a voltage pulse (dummy pulse) to a heating element of a thermal head (print head) while performing printing on a print area. For example, Japanese Patent Laying-Open Nos. 56-161182 (1981) and 9-216398 (1997) propose such structures.

The aforementioned Japanese Patent Laying-Open No. 56-161182 describes a printer capable of suppressing reduction of print density by inhibiting the temperature of a heating element of a thermal head (print head) from decreasing below a proper level by applying a dummy pulse (voltage pulse) of an energy level causing no reaction of a thermal recording medium to the heating element also when a recording period is increased to reduce the temperature of the heating element below the proper level during printing in a print area.

The aforementioned Japanese Patent Laying-Open No. 9-216398 describes a printer, heating an ink sheet with a plurality of linear heating elements provided on a thermal head (print head) for forming dots by printing ink from portions corresponding to the heating elements onto a paper, capable of suppressing reduction of print density by applying a dummy pulse (voltage pulse) not increased to a printing temperature to the heating elements thereby increasing the temperature of the heating elements to a proper level. This printer applies the dummy pulse in line printing immediately before forming new dots when not continuously forming dots over a plurality of lines during printing in a print area.

However, while the printers described in the aforementioned Japanese Patent Laying-Open Nos. 56-161182 and 9-216398 can increase the temperatures of the heating elements to proper levels during printing, each literature neither discloses nor suggests a method of increasing the temperature (s) of the heating element(s) to a proper level when the thermal head (print head) comes into contact with the paper to reduce the temperature(s) of the heating element(s) when starting printing. When the printer applies the voltage pulse for printing to the heating element(s) of the thermal head (print head) immediately after bringing the thermal head (print head) into contact with the paper in an initial stage of printing, therefore, the temperature(s) of the heating element (s) is reduced dye to the contact with the paper, not to reach the proper level for starting printing. Therefore, print density is disadvantageously reduced in the initial stage of printing.

In this regard, a printer capable of increasing the temperature of a heating element of a thermal head (print head) to a proper level by applying a voltage pulse before starting printing (transfer) is proposed in general, as described in Japanese Patent No. 3109386, for example.

The aforementioned Japanese Patent No. 3109386 proposes a printer capable of increasing the temperature of a heating element of a thermal head (print head) to a proper level for starting transferring an overcoat material for protecting a print face to a paper by applying a voltage pulse to the heating element in a transfer area (print area) before starting the transfer operation. This printer applies the voltage pulse to the heating element by five lines without carrying the paper on a first line of the transfer area when starting transferring the overcoat material. When the technique disclosed in Japanese Patent No. 3109386 is applied to a colored ink sheet other than the overcoat material, it may conceivably possible to increase the temperature of a heating element to a proper level for starting printing by applying a voltage pulse to the heating element on a print area by five lines without carrying a paper before starting printing with the colored ink sheet.

Also when the technique disclosed in the aforementioned Japanese Patent No. 3109386 is applied to printing with a colored ink sheet, however, heat easily locally remains in the heating element of the thermal head since the printer applies the voltage pulse to the heating element without carrying the paper before starting printing. Therefore, ink of the colored ink sheet disadvantageously easily adheres to the paper due to the heat locally remaining in the heating element. Consequently, the printer must apply a large number of pulses to the heating element with a short voltage pulse width at long time intervals so that no ink adheres to the paper, and hence the time for increasing the temperature of the heating element to the proper level for starting printing is disadvantageously increased.

SUMMARY OF THE INVENTION

The present invention has been proposed in order to solve the aforementioned problems, and an object of the present invention is to provide a printer capable of reducing a time for increasing the temperature of a heating element to a proper level for starting printing beforehand and suppressing density reduction in an initial stage of printing.

A printer according to a first aspect of the present invention comprises a print head having a heating element for printing an image on a paper by transferring ink from an ink sheet to the paper, a platen roller against which the print head is pressed through the ink sheet and the paper and print head control means applying a prescribed voltage to the heating element of the print head while carrying the paper after pressing the print head against the platen roller and before starting printing.

The printer according to the first aspect, comprising the print head control means applying the prescribed voltage to the heating element of the print head after pressing the print head against the platen roller and before starting printing as hereinabove described, can increase the temperature of the heating element of the print head to the proper level for starting printing beforehand, whereby reduction of print density can be suppressed in an initial stage of printing. Further, the print head control means applies the prescribed voltage to the heating element of the print head while carrying the paper for dispersing heat generated from the heating element by carrying the paper, whereby the heat can be inhibited from locally remaining in the heating element dissimilarly to a case of applying the voltage to the heating element of the print head without carrying the paper. Therefore, the ink can be inhibited from adhering to the paper also when the print head control means applies a voltage higher than that locally leaving the heat in the heating element, whereby the time for increasing the temperature of the heating element can be reduced by applying a high voltage. According to the present invention, not only characters but also images can be printed with the print head.

In the aforementioned printer according to the first aspect, the paper is preferably so arranged that the heating element of the print head presses a margin of the paper separated from a print area of the paper by a prescribed distance when the print head presses the platen roller before starting the printing, and the print head control means preferably applies the prescribed voltage to the heating element of the print head while carrying the paper from a position where the heating element of the print head presses the margin to a position where the heating element presses the print area. According to this structure, the temperature of the heating element of the print head can be increased to the proper level for starting printing while the paper is carried from the position where the heating element of the print head presses the margin to the position where the heating element presses the print area, whereby the heating element of the print head is at the proper temperature when reaching the print area of the paper. Thus, the printer can simultaneously start the printing when the heating element of the print head reaches the print area, not to delay the start of printing.

In this case, the printer preferably starts the printing by applying the prescribed voltage to the heating element of the print head on the basis of image data for the printing when the heating element of the print head passes through the margin and reaches the print area of the paper. According to this structure, the printer can easily simultaneously start the printing when the heating element of the print head reaches the print area of the paper.

In the aforementioned printer according to the first aspect, the ink sheet preferably has a sheet of a plurality of colors, and the print head control means preferably applies the voltage to the heating element of the print head while carrying the paper after pressing the print head against the platen roller and before starting printing every color of the ink sheet. According to this structure, the printer, capable of increasing the temperature of the heating element to the level proper for starting the printing every color of the ink sheet beforehand, can easily suppress reduction of print density in the initial stage of printing and improve printing quality.

In the aforementioned printer according to the first aspect, the voltage is preferably a voltage pulse, and the print head control means preferably applies the voltage pulse to the heating element of the print head by a prescribed paper feed while carrying the paper before starting the printing. According to this structure, the printer can easily control the temperature of the heating element by changing the width of the voltage pulse. Further, the printer, capable of increasing the temperature of the heating element by applying the voltage pulse to the heating element by the prescribed feed, can control the temperature of the heating element also according to this structure.

The aforementioned printer applying the voltage pulse preferably further comprises a color table provided in correspondence to every prescribed temperature of the print head for deciding an application time of the voltage pulse applied to the heating element of the print head, and the print head control means preferably applies the voltage pulse to the heating element of the print head for an application time corresponding to a prescribed gradation of the color table. According to this structure, the printer, capable of applying the voltage pulse to the heating element for the optimum voltage pulse application time based on the temperature of the print head, can precisely increase the temperature of the heating element to the level proper for starting the printing beforehand.

In the aforementioned printer comprising the color table, the color table preferably includes a plurality of voltage pulse width data corresponding to a plurality of colors respectively, and the print head control means preferably applies the voltage pulse to the heating element of the print head for a time corresponding to the voltage pulse width data of a gradation zero of each of the plurality of colors before starting the printing. According to this structure, the printer can easily inhibit the temperature of the heating element of the print head from excessive increase before starting printing every sheet in the plurality of colors corresponding to the plurality of voltage pulse width data respectively.

In this case, the application time corresponding to the voltage pulse width data of the gradation zero is preferably shorter than an application time for transferring the ink from the ink sheet to the paper. According to this structure, the printer can inhibit the ink from transfer from the ink sheet to the paper before starting the printing.

In the aforementioned printer applying the voltage pulse, the print head control means preferably applies the voltage pulse on the basis of dummy image data while carrying the paper before starting the printing. According to this structure, the printer can apply the voltage pulse to the heating element of the print head before starting the printing in a method similar to that in the printing.

The aforementioned printer applying the voltage pulse preferably further comprises a temperature sensor chip for detecting the temperature around the heating element of the print head, and the print head control means preferably applies the voltage pulse to the heating element of the print head by a plurality of lines for a time corresponding to the temperature detected by the temperature sensor chip while the heating element of the print head passes through a margin of the paper separated from a print area of the paper by a prescribed distance. According to this structure, the printer, capable of applying the voltage pulse to the heating element for the optimum voltage pulse application time based on the temperature of the print head, can precisely increase the temperature of the heating element to the level proper for starting the printing beforehand.

In this case, the temperature sensor chip preferably detects the temperature around the heating element of the print head every line while the print head control means applies the voltage pulse to the heating element of the print head for a time corresponding to the temperature detected by the temperature sensor chip every line when the heating element of the print head passes through the margin and reaches the print area of the paper. According to this structure, the printer, capable of controlling the temperature of the heating element of the print head every line in normal printing after the heating element passes through the margin, can improve printing quality.

A printer according to a second aspect of the present invention comprises a print head having a heating element for printing an image on a paper by transferring ink of an ink sheet having a sheet of a plurality of colors to the paper, a platen roller against which the print head is pressed through the ink sheet and the paper, print head control means applying a prescribed voltage pulse to the heating element of the print head and a color table provided in correspondence to every prescribed temperature of the print head for deciding an application time of the voltage pulse applied to the heating element of the print head, the paper is so arranged that the heating element of the print head presses a margin of the paper separated from a print area of the paper by a prescribed distance when the print head presses the platen roller before starting the printing, and the print head control means applies the prescribed voltage pulse to the heating element of the print head for an application time corresponding to a prescribed gradation of the color table by a prescribed paper feed while carrying the paper from a position where the heating element of the print head presses the margin to a position where the heating element presses the print area after pressing the print head against the platen roller and before starting printing every color of the ink sheet.

As hereinabove described, the printer according to the second aspect, comprising the print head control means applying the prescribed voltage pulse to the heating element of the print head after pressing the print head against the platen roller and before starting printing as hereinabove described, can increase the temperature of the heating element of the print head to a proper level for starting printing beforehand, whereby reduction of print density can be suppressed in an initial stage of printing. Further, the print head control means applies the prescribed voltage pulse to the heating element of the print head while carrying the paper for dispersing heat generated from the heating element by carrying the paper, whereby the heat can be inhibited from locally remaining in the heating element dissimilarly to a case of applying the voltage pulse to the heating element of the print head without carrying the paper. Therefore, the ink can be inhibited from adhering to the paper also when the print head control means applies a voltage pulse higher than that locally leaving the heat in the heating element, whereby the time for increasing the temperature of the heating element can be reduced by applying a high voltage pulse. According to the present invention, not only characters but also images can be printed with the print head. Further, the paper is so arranged that the heating element of the print head presses the margin of the paper separated from the print area of the paper by the prescribed distance when the print head presses the platen roller before starting the printing, and the print head control means applies the prescribed voltage pulse to the heating element of the print head while carrying the paper from the position where the heating element of the print head presses the margin to the position where the heating element presses the print area so that the temperature of the heating element of the print head can be increased to the proper level for starting printing while the paper is carried from the position where the heating element of the print head presses the margin to the position where the heating element presses the print area, whereby the heating element of the print head is at the proper temperature when reaching the print area of the paper. Thus, the printer can simultaneously start the printing when the heating element of the print head reaches the print area, not to delay the start of printing. In addition, the print head control means applies the voltage pulse to the heating element of the print head while carrying the paper after pressing the print head against the platen roller and before starting printing every color of the ink sheet, whereby the printer, capable of increasing the temperature of the heating element to the level proper for starting the printing every color of the ink sheet beforehand, can easily suppress reduction of print density in the initial stage of printing and improve printing quality. Further, the print head control means applies the voltage pulse to the heating element of the print head for an application time corresponding to a prescribed gradation of the color table, whereby the printer, capable of applying the voltage pulse to the heating element for the optimum voltage pulse application time based on the temperature of the print head regardless of the temperature of the print head, can precisely increase the temperature of the heating element to the level proper for starting the printing beforehand.

The aforementioned printer according to the second aspect preferably starts the printing by applying the prescribed voltage pulse to the heating element of the print head on the basis of image data for the printing when the heating element of the print head passes through the margin and reaches the print area of the paper. According to this structure, the printer can easily simultaneously start the printing when the heating element of the print head reaches the print area of the paper.

In the aforementioned printer according to the second aspect, the color table preferably includes a plurality of voltage pulse width data corresponding to the plurality of colors respectively, and the print head control means preferably applies the voltage pulse to the heating element of the print head for a time corresponding to the voltage pulse width data of a gradation zero of each of the plurality of colors before starting the printing. According to this structure, the printer can easily inhibit the temperature of the heating element of the print head from excessive increase before starting printing every sheet in the plurality of colors corresponding to the plurality of voltage pulse width data respectively.

In this case, the application time corresponding to the voltage pulse width data of the gradation zero is preferably shorter than an application time for transferring the ink from the ink sheet to the paper. According to this structure, the printer can inhibit the ink from transfer from the ink sheet to the paper before starting the printing.

In the aforementioned printer according to the second aspect, the print head control means preferably applies the voltage pulse on the basis of dummy image data while carrying the paper before starting the printing. According to this structure, the printer can apply the voltage pulse to the heating element of the print head before starting the printing in a method similar to that in the printing.

The aforementioned printer according to the second aspect preferably further comprises a temperature sensor chip for detecting the temperature around the heating element of the print head, and the print head control means preferably applies the voltage pulse to the heating element of the print head by a plurality of lines for a time corresponding to the temperature detected by the temperature sensor chip while the heating element of the print head passes through the margin. According to this structure, the printer, capable of applying the voltage pulse to the heating element for the optimum voltage pulse application time based on the temperature of the print head, can precisely increase the temperature of the heating element to the level proper for starting the printing beforehand.

In this case, the temperature sensor chip preferably detects the temperature around the heating element of the print head every line while the print head control means applies the voltage pulse to the heating element of the print head for a time corresponding to the temperature detected by the temperature sensor chip every line when the heating element of the print head passes through the margin and reaches the print area of the paper. According to this structure, the printer, capable of controlling the temperature of the heating element of the print head every line in normal printing after the heating element passes through the margin, can improve printing quality.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a thermal transfer printer according to the embodiment of the present invention is described with reference to FIGS. 1 to 13. According to this embodiment, the present invention is applied to the thermal transfer printer, which is an exemplary printer.

Figure 1:
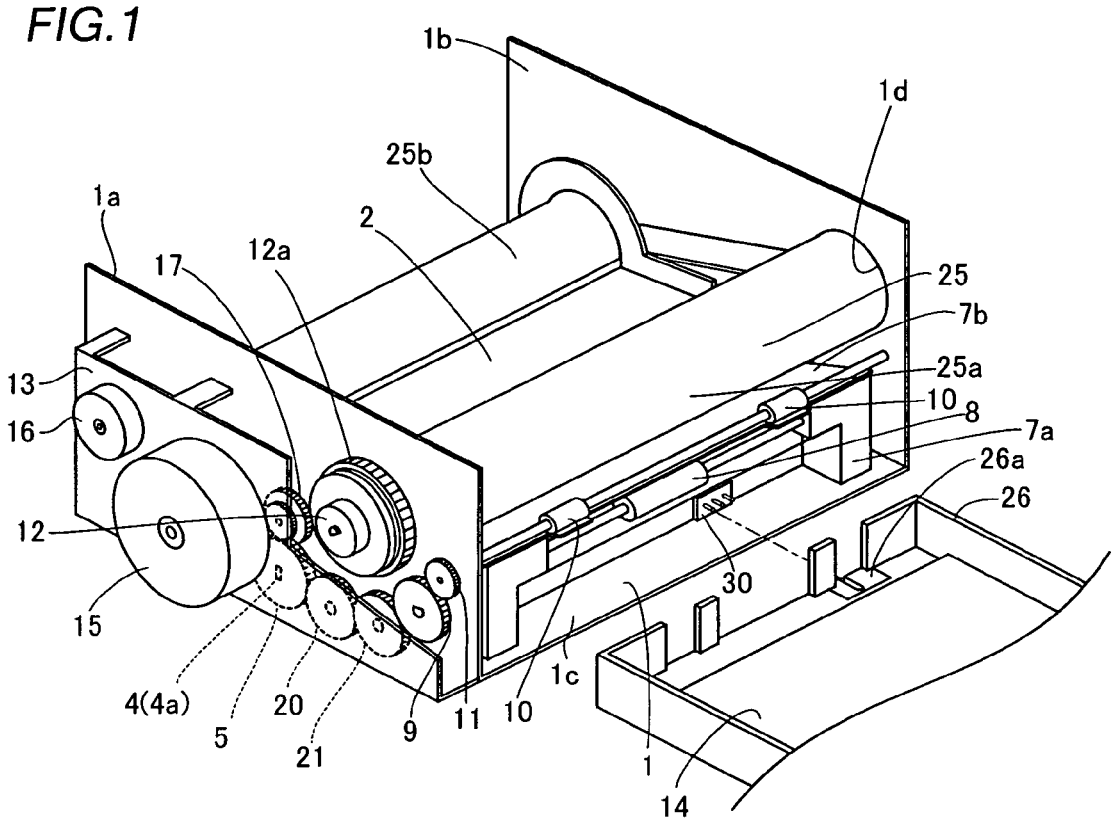
FIG. 1 is a perspective view showing the overall structure of a thermal transfer printer according to an embodiment of the present invention.
Figure 2:
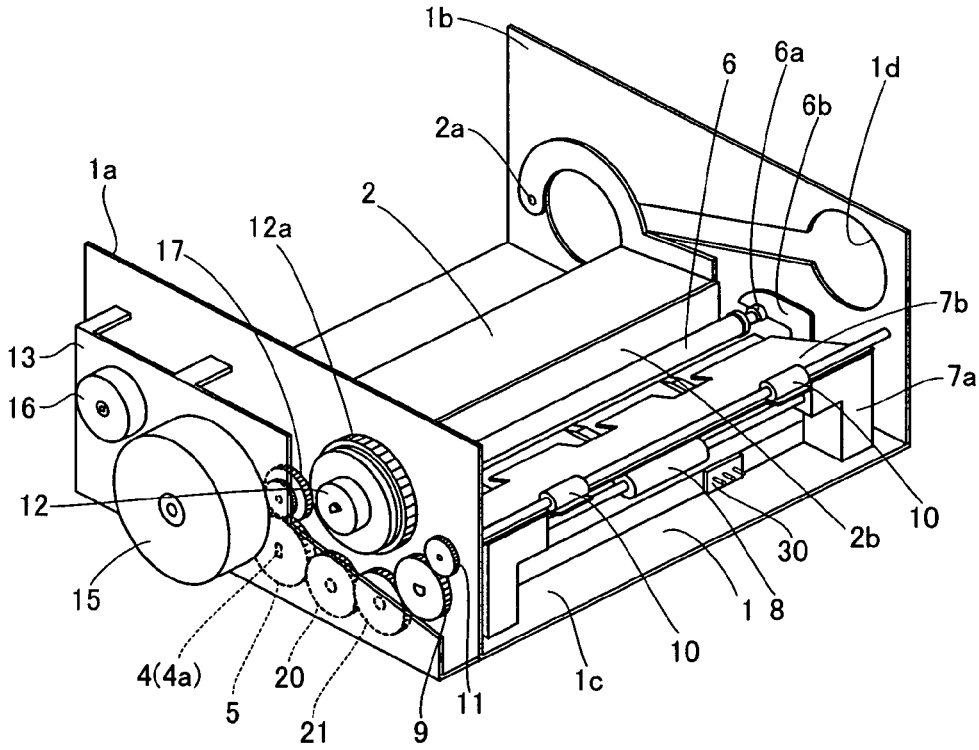
FIG. 2 is a perspective view of the thermal transfer printer according to the embodiment of the present invention shown in FIG. 1, from which an ink sheet cartridge is removed.

As shown in FIGS. 1 and 2, the thermal transfer printer according to this embodiment of the present invention comprises a chassis 1 of metal, a print head 2 for printing, a platen roller 3 (see FIG. 12) opposed to the print head 2, a feed roller 4 (see FIG. 12) of metal, a feed roller gear 5, a press roller 6 (see FIG. 12) of metal pressing the feed roller 4 with prescribed pressing force, a lower paper guide 7*a* of resin, an upper paper guide 7*b* of resin, a paper feed roller 8 of rubber, a paper feed roller gear 9, a paper discharge roller 10 of rubber, a paper discharge roller gear 11, a take-up reel 12, a motor bracket 13, a paper feed motor 15 for carrying a paper 14, a print head rotating motor 16 rotating the print head 2, a swingable swing gear 17, a plurality of intermediate gears 18 to 21 (see FIG. 4), a circuit portion 23 (see FIG. 3) controlling the thermal transfer printer on the basis of image data 22 (see FIG. 3) for printing and a power supply portion 24 (see FIG. 3) for supplying power to the thermal transfer printer. An ink sheet cartridge 25 and a paper feed cassette case 26 for storing the paper 14 fed to the thermal transfer printer are mounted on the thermal transfer printer according to this embodiment, as shown in FIG. 1.

As shown in FIGS. 1 and 2, the chassis 1 has a first side surface 1*a*, a second side surface 1*b* and a bottom surface 1*c*. The aforementioned bracket 13 is mounted on the first side surface 1*a* of the chassis 1. A sheet width recognition switch member 27 (see FIG. 5) having three switches is provided inside the first side surface 1*a* of the chassis 1. A receiving hole 1*d* for receiving the ink sheet cartridge 25 is provided on the second side surface 1*b* of the chassis 1. Further, a sheet search sensor 28 (see FIG. 12) is provided on the bottom surface 1*c* of the chassis 1.

Figure 5:
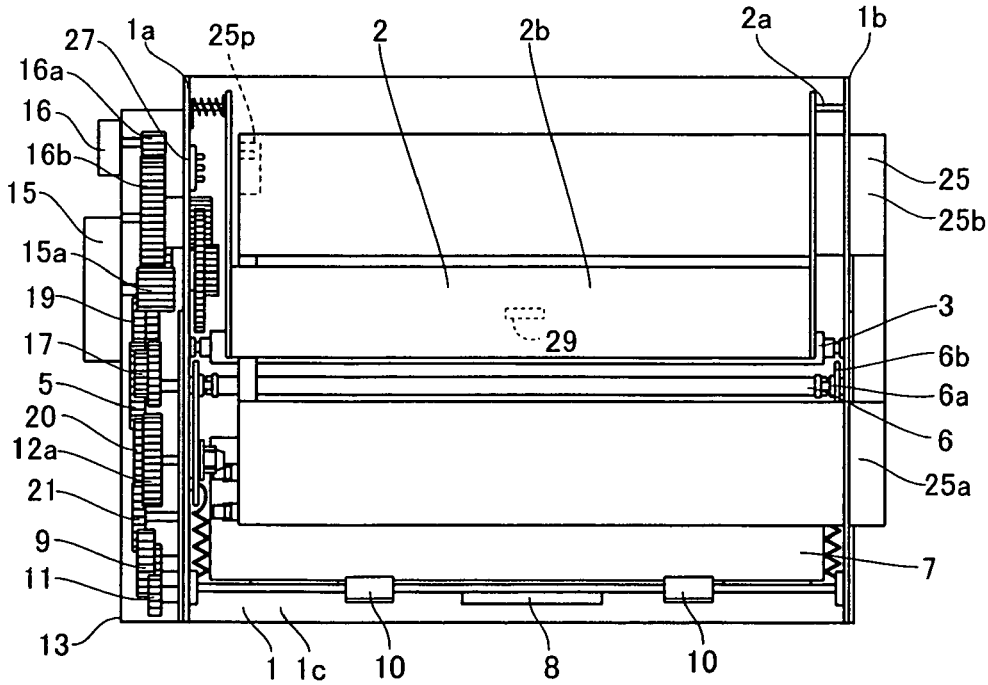
FIG. 5 is a plan view of the thermal transfer printer according to the embodiment of the present invention shown in FIG. 1.
Figure 6:
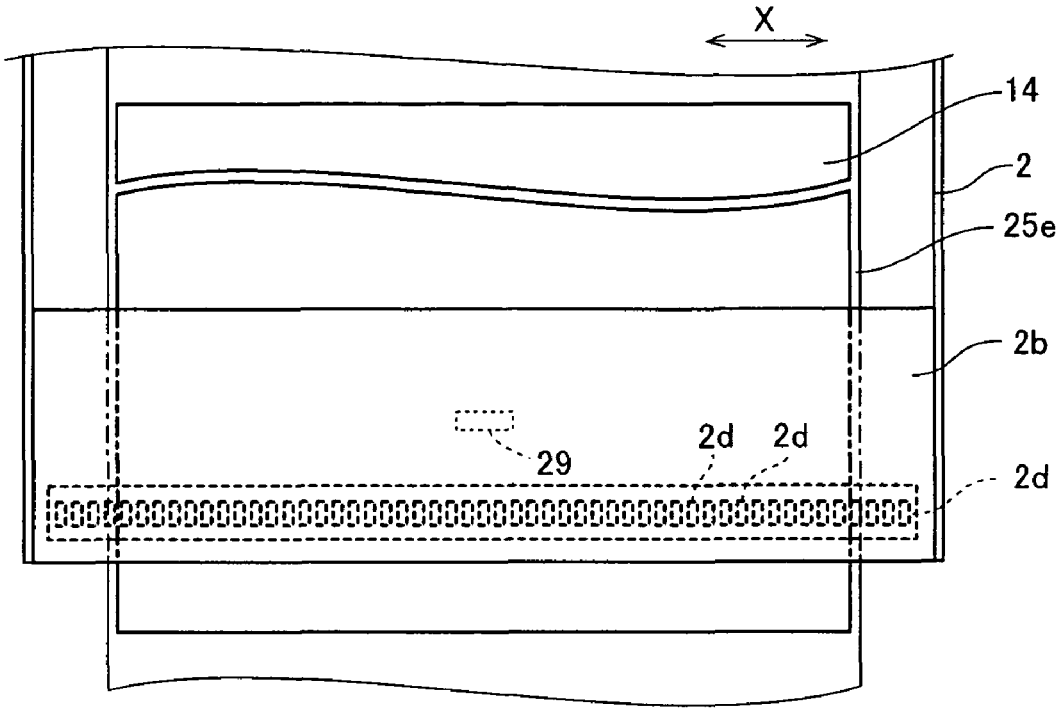
FIG. 6 is a detailed diagram of a print head of the thermal transfer printer according to the embodiment of the present invention shown in FIG. 1.
Figure 7:
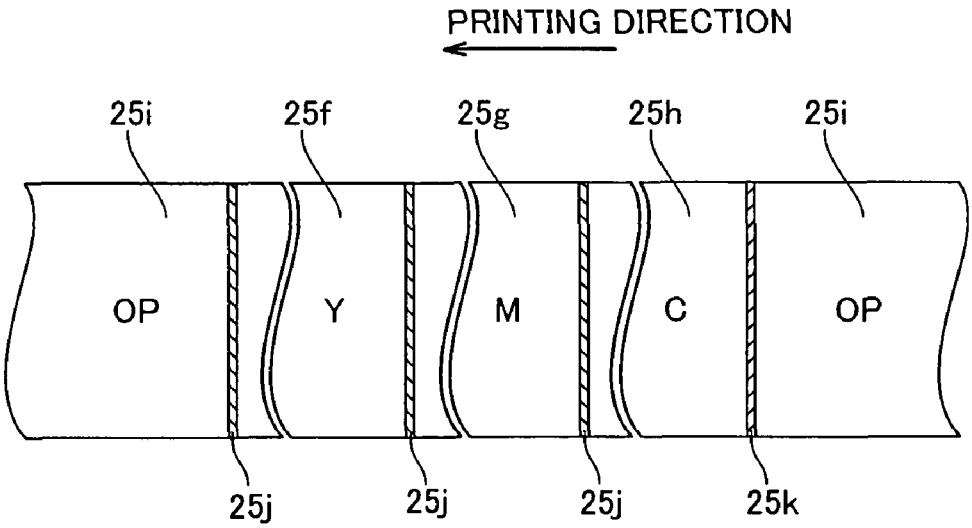
FIG. 7 illustrates an exemplary color table in the thermal transfer printer according to the embodiment of the present invention shown in FIG. 1.
Figure 12:
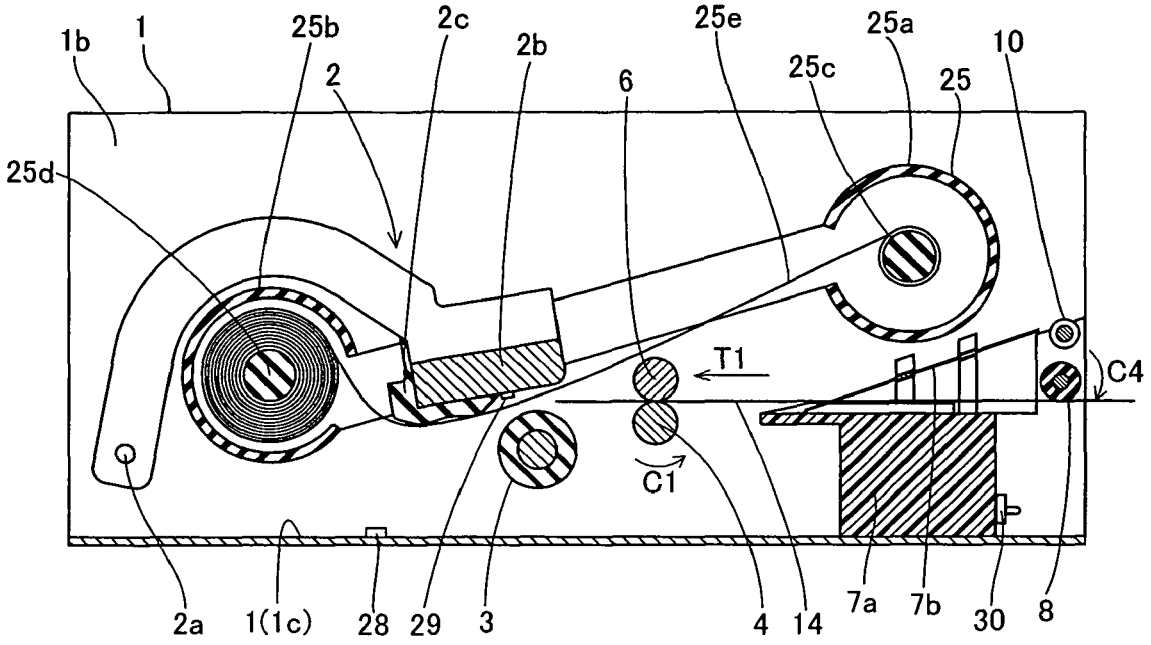
FIGS. 12 to 14 are sectional view of the thermal transfer printer according to the embodiment of the present invention shown in FIG. 1.

The print head 2 includes a support shaft 2*a*, a head portion 2*b* and a head cover 2*c* (see FIG. 12) of resin mounted on the head portion 2*b*. As shown in FIG. 6, a plurality of heating elements 2*d* generating heat upon application of a voltage pulse are aligned on the head portion 2*b* of the print head 2 at prescribed intervals along the width direction (direction X in FIG. 6) of the paper 14. 1280 heating elements 2*d* are so provided that each heating element 2*d* forms a dot in printing. As shown in FIG. 12, a temperature sensor chip 29 for detecting the temperature around the heating elements 2*d* of the print head 2 is provided in the vicinity of the heating elements 2*d* on the bottom surface of the print head 2. As shown in FIG. 2, the print head 2 is mounted inside both side surfaces 1*a* and 1*b* of the chassis 1, to be rotatable about the support shaft 2*a*. The platen roller 3 (see FIG. 5) is rotatably supported by platen roller bearings (not shown) mounted on both side surfaces 1*a* and 1*b* of the chassis 1.

Figure 4:
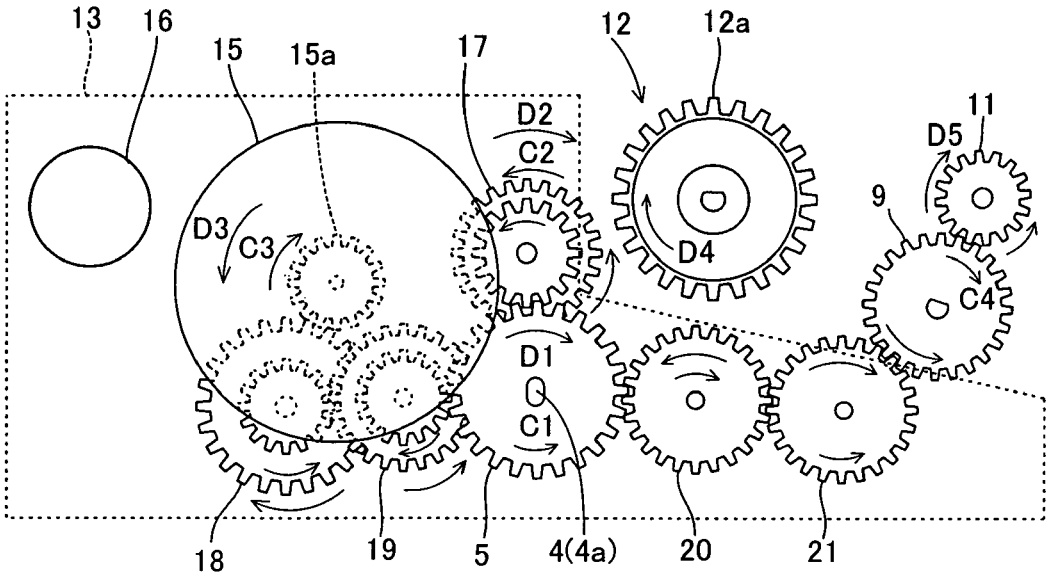
FIG. 4 is a front elevational view showing a stepping motor and respective gears of the thermal transfer printer according to the embodiment of the present invention shown in FIG. 1.

As shown in FIG. 4, the feed roller 4 has a feed roller gear insert portion 4*a* inserted into the feed roller gear 5. The feed roller 4 is rotatably supported by a feed roller bearing (not shown) mounted on the chassis 1. As shown in FIGS. 2 and 5, the press roller 6 is rotatably supported by a press roller bearing 6*a* mounted on a bearing support plate 6*b*. The bearing support plate 6*b* is arranged inside both side surfaces 1*a* and 1*b* of the chassis 1, for pressing the press roller 6 against the feed roller 4.

As shown in FIG. 4, a motor gear 15*a* is mounted on a shaft portion of the paper feed motor 15 mounted on the motor bracket 13. The paper feed motor 15 has a function serving as a drive source for driving a gear portion 12*a* of the take-up reel 12, the paper feed roller gear 9, the paper discharge roller gear 11 and the feed roller gear 5. The print head rotating motor 16 has a function of vertically rotating the print head 2 with a gear (not shown) for pressing and separating the print head 2 against and from the platen roller 3.

The take-up reel 12 engages with a take-up bobbin 25*c* arranged in a take-up portion 25*a* of the ink sheet cartridge 25, thereby taking up an ink sheet 25*e* wound on the take-up bobbin 25*c*. As shown in FIG. 5, the gear portion 12*a* of the take-up reel 12 meshes with the swing gear 17 upon swinging thereof.

As shown in FIGS. 1, 2 and 12, the lower paper guide 7*a* is set in the vicinity of the feed roller 4 (see FIG. 12) and the press roller 6. The lower paper guide 7*a* is provided with a paper width recognition switch member 30 having three switches, as shown in FIGS. 1 and 2. The upper paper guide 7*b* is mounted on the upper portion of the lower paper guide 7*a*. The upper paper guide 7*b* has a function of guiding the paper 14 to a paper feed path toward a printing portion through the lower surface thereof in paper feeding while guiding the paper 14 to a paper discharge path through the upper surface thereof in paper discharge.

Figure 10:
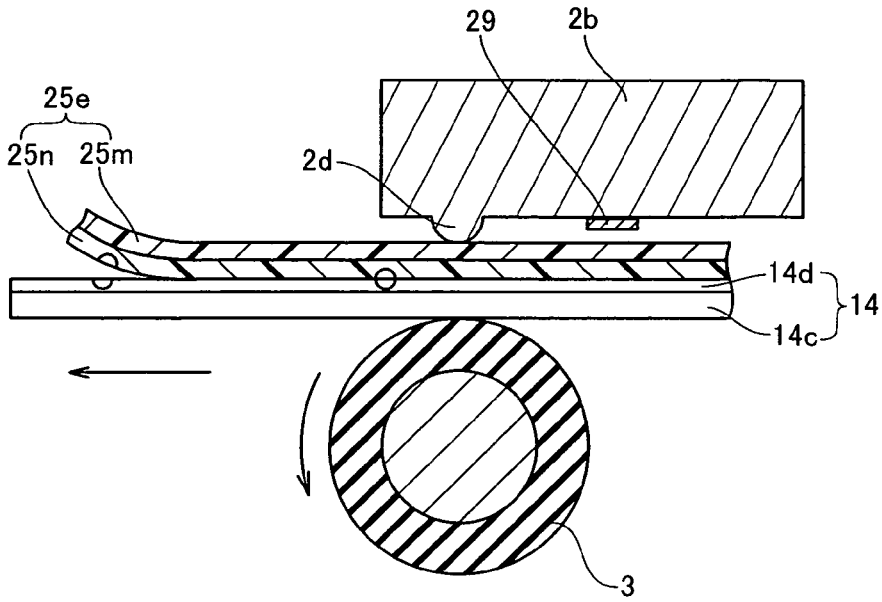
FIG. 10 is a sectional view for illustrating ink transfer in the thermal transfer printer according to the embodiment of the present invention shown in FIG. 1.

As shown in FIGS. 1 and 2, the ink sheet cartridge 25 has the take-up portion 25*a* and a feed portion 25*b*. As shown in FIG. 12, the take-up bobbin 25*c* is rotatably arranged in the take-up portion 25*a* of the ink sheet cartridge 25. Further, a feed bobbin 25*d* is rotatably arranged in the feed portion 25*b* of the ink sheet cartridge 25. The ink sheet 25*e* for printing images on the paper 14 is wound on the take-up bobbin 25*c* and the feed bobbin 25*d*. This ink sheet 25*e* has three color printing sheets 25*f*, 25*g* and 25*h* of Y (yellow), M (magenta) and C (cyan) and transparent OP (overcoat) sheets 25*i* for protecting a print surface of the printed paper 14. Identification portions 25*j* recognized by the sheet search sensor 28 are provided between the color printing sheets 25*f* to 25*h*, while a further identification portion 25*k* recognized by the sheet search sensor 28 is provided between the printing sheet 25*h* of C (cyan) and the OP (overcoat) sheet 25*i* adjacent thereto. As shown in FIG. 10, the ink sheet 25*e* is constituted of a base film layer 25*m* and a dye ink layer 25*n*.

As shown in FIG. 5, a contact portion 25*p* having three or less recess portions is provided on an end of the feed portion 25*b* of the ink sheet cartridge 25. Each recess portion of the contact portion 25*p* is provided in correspondence to any of the three switches of the sheet width recognition switch member 27. Thus, the switches of the sheet width recognition switch member 27 corresponding to the recess portions remain in non-input states when the ink sheet cartridge 25 is mounted on the thermal transfer printer, so that the ink sheet width is recognized through combination of an input switch and the non-input switches.

As shown in FIG. 1, another contact portion 26*a* having three or less recess portions is provided on an end surface of the paper feed cassette case 26. Each recess portion of the contact portion 26*a* is provided in correspondence to any of the three switches of the paper width recognition switch member 30. Thus, the switches of the paper width recognition switch member 30 corresponding to the recess portions remain in non-input states when the paper feed cassette case 26 is mounted on the thermal transfer printer, so that the width of the paper 14 can be recognized through combination of an input switch and the non-input switches.

Figure 11:
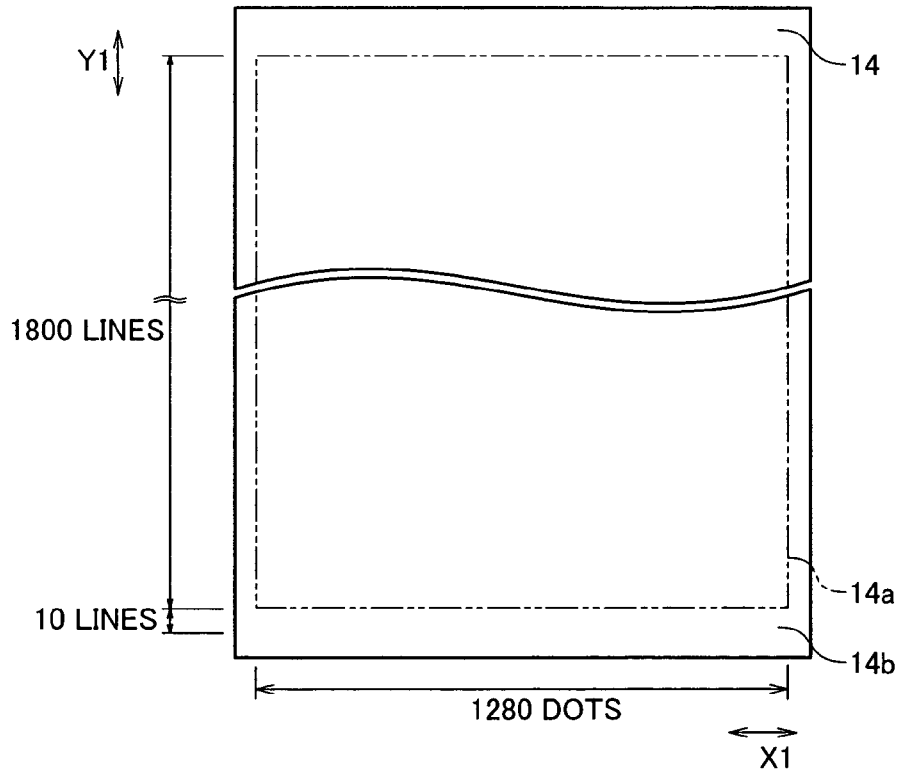
FIG. 11 is a plan view of a paper employed in the thermal transfer printer according to the embodiment of the present invention shown in FIG. 1.

As shown in FIG. 10, the paper 14 is constituted of a substrate 14*c* and a receptive layer 14*d* to which ink is transferred. As shown in FIG. 11, the paper 14 has a print area 14*a* and a margin 14*b* around the print area 14*a*. The print area 14*a* has 1280 dots in the width direction (direction X1) of the paper 14 and 1800 lines in the longitudinal direction (direction Y1) of the paper 14. The "line" denotes the paper feed unit for the carried paper 14, and the thermal transfer printer performs printing while carrying the paper 14 line by line. The lines are examples of the "paper feed" in the present invention.

Figure 3:
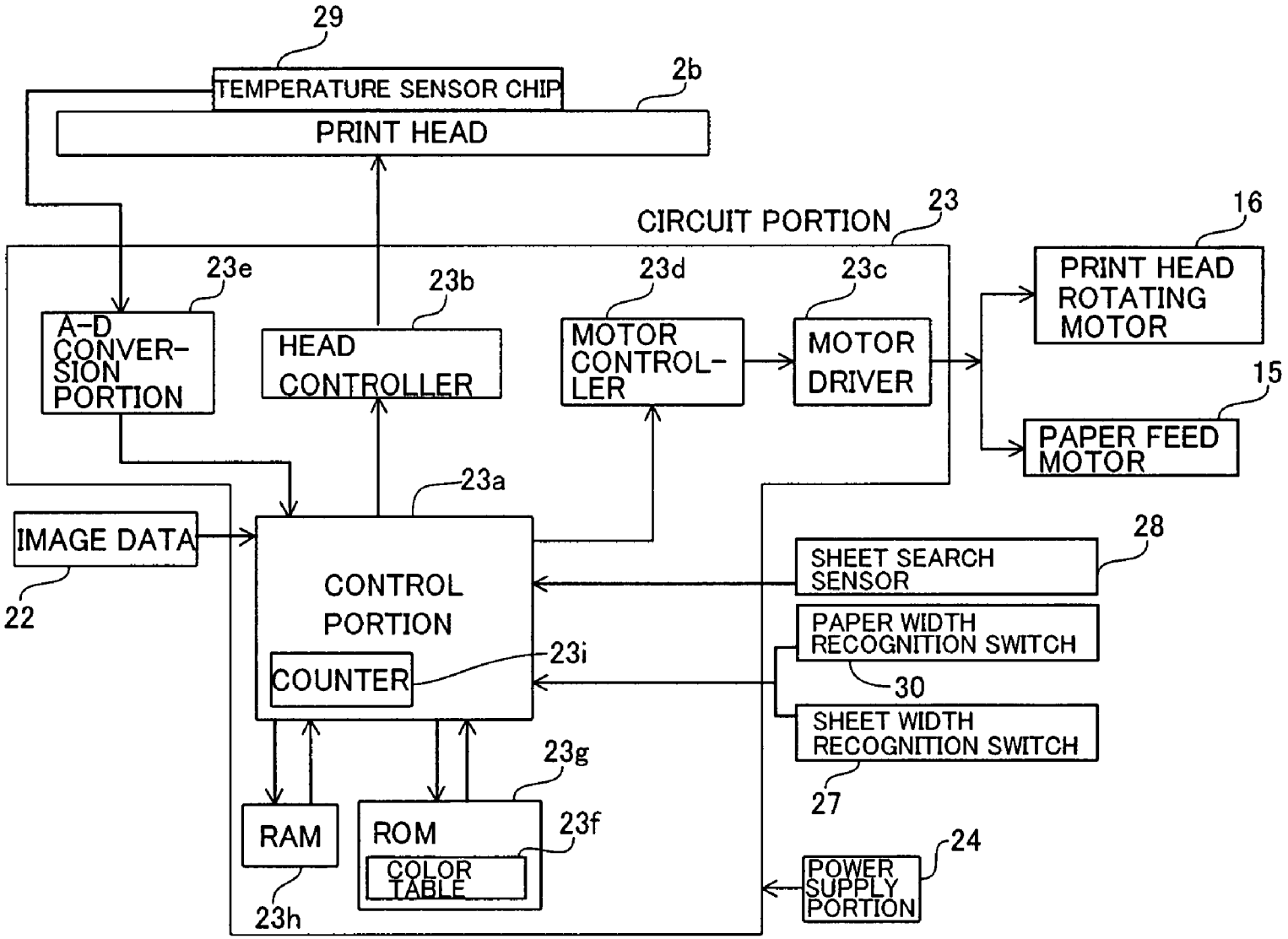
FIG. 3 is a block diagram showing the circuit structure of the thermal transfer printer according to the embodiment of the present invention shown in FIG. 1.

As shown in FIG. 3, the circuit portion 23 includes a control portion 23*a* controlling the printing operation of the thermal transfer printer, a head controller 23*b* controlling the temperatures of the heating elements 2*d* of the print head 2, a motor driver 23*c*, a motor controller 23*d*, an A-D conversion portion 23*e*, a ROM 23*g* having a color table 23*f* and a RAM 23*h* for developing the color table 23*f*. The motor driver 23*d* controls the print head rotating motor 16 and the paper feed motor 15 through the motor controller 23*d*. The head controller 23*b* controls the temperatures of the heating elements 2*d* of the print head 2 by applying a voltage pulse thereto. The A-D conversion portion 23*e* converts an analog voltage value detected by the temperature sensor chip 29 provided in the vicinity of the heating elements 2*d* of the print head 2 to a digital value.

Figure 8:
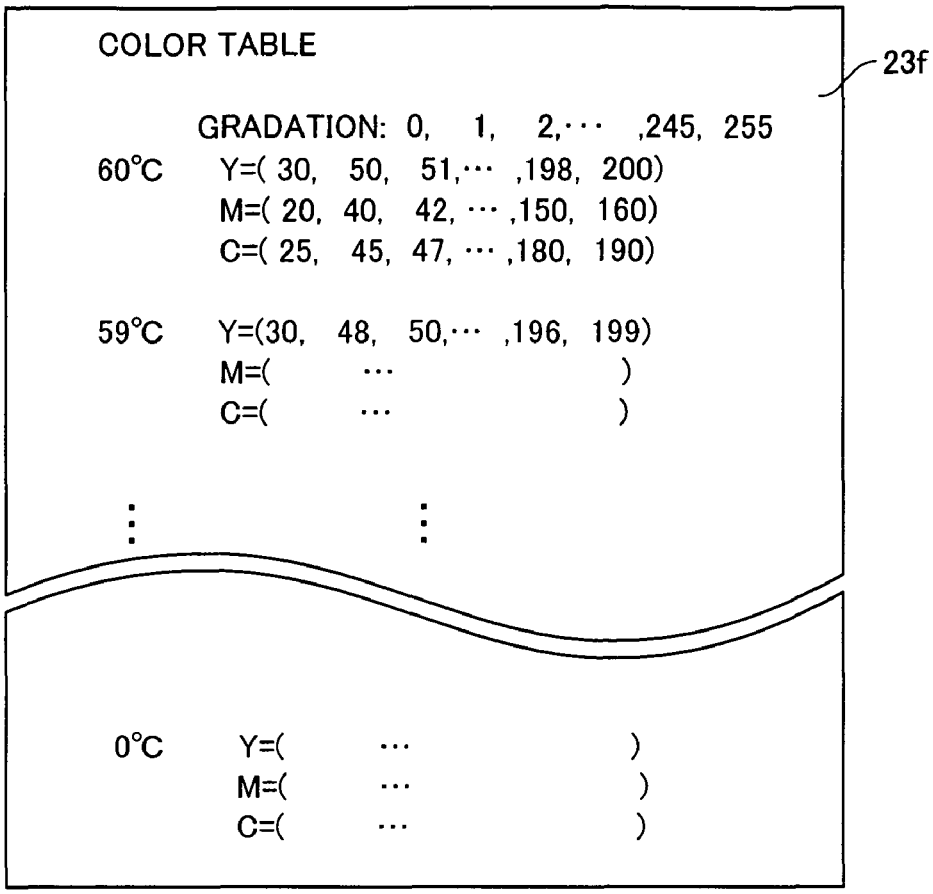
FIG. 8 is a diagram for illustrating an ink sheet of the thermal transfer printer according to the embodiment of the present invention shown in FIG. 1.

As shown in FIG. 8, the color table 23*f* stores voltage pulse widths every gradation of the ink sheet 25*e*. For example, the color table 23*f* stores temperatures corresponding to those detected by the temperature sensor chip 29 stored every degree centigrade in the temperature range of 0° C. to 60° C. and voltage pulse widths (relative values) corresponding to the respective gradations of the Y, M and C printing sheets 25*f*, 25*g* and 25*h* at the respective temperatures. As shown in FIG. 8, further, the color table 23*f* stores gradations zero to 255, i.e., 256 gradations of the respective colors. Referring to FIG. 8, each of parentheses of Y=( . . . ), M=( . . . ) and C=( . . . ) successively stores 256 voltage pulse widths from that corresponding to the gradation zero to that corresponding to the gradation 255. The voltage pulse widths are examples of the "application time" in the present invention.

With reference to the Y printing sheet 25*f* at the temperature of 60° C., the first and second values "30" and "50" in the parenthesis (30, 50, 51, . . . , 198, 200) are the voltage pulse widths (relative values) of the gradations zero and 1 respectively. In each of the Y, M and C printing sheets 25*f*, 25*g* and 25*h*, the voltage pulse width (relative value) of the gradation zero is about ⅔ of the voltage pulse width (relative value) of the gradation 1 at each temperature. Further, the voltage pulse width (relative value) of the gradation zero is at such a value that no ink is printed on (transferred to) the paper 14 from the ink sheet 25*e*. In other words, the voltage pulse width (relative value) of the gradation zero is shorter than a pulse width for printing (transferring) the ink from the ink sheet 25*e* on (to) the paper 14. In addition, the levels of energy supplied to the heating elements 2*d* are reduced in order of the Y, C and M printing sheets 25*f*, 25*h* and 25*g*, and hence the color table 23*f* so stores the voltage pulse widths (relative values) to be reduced along the order of the Y, C and M printing sheets 25*f*, 25*h* and 25*g*.

According to this embodiment, the thermal transfer printer employs the voltage pulse widths of the gradation zero of the color table 23*f* corresponding to each temperature for the voltage pulse applied to the heating elements 2*d* of the print head 2 before starting printing.

Figure 9:
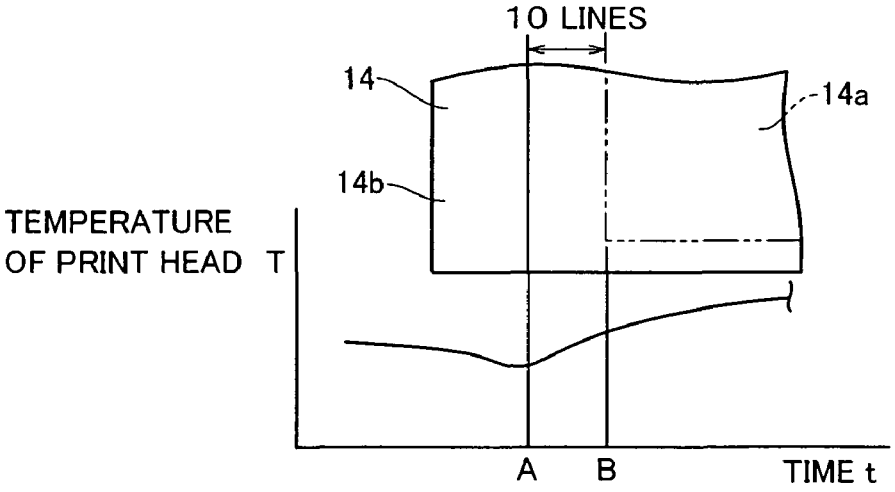
FIG. 9 illustrates a temperature buildup curve of a heating element of the thermal transfer printer according to the embodiment of the present invention shown in FIG. 1.

According to this embodiment, the control portion 23*a* has a function of issuing instructions to the motor controller 23*d* and the head controller 23*b* to apply a voltage pulse (see FIG. 9) to the heating elements 2*d* of the print head 2 by 10 lines with the voltage pulse widths of the gradation zero in the color table 23*f* (see FIG. 8) corresponding to each temperature while carrying the paper 14 after pressing the heating elements 2*d* of the print head 2 against the platen roller 3 through the paper 14 and the ink sheet 25*e* and before starting printing (point A in FIG. 9), as shown in FIG. 9. The control portion 23*a* is an example of the "print head control means" in the present invention.

The control portion 23*a* is provided with a counter 23*i* (see FIG. 3) counting the number of lines in a paper discharge direction (direction Y1 in FIG. 11) for the paper 14 while also counting the number of dots (i) in the width direction (direction X1 in FIG. 11) of the paper 14.

The printing operation of the thermal printer according to the embodiment of the present invention for each color of the ink sheet 25*e* is described with reference to FIGS. 1, 4, 5, 7, 9 and 11 to 15. At a step S1, the control portion 23*a* determines whether or not the power supply portion 24 is in an ON-state. If the power supply portion 24 is in an OFF-state, the control portion 23*a* repeats this determination until the power supply portion 24 enters an ON-state. When the power supply portion 24 enters an ON-state, the control portion 23*a* determines whether or not a print button (not shown) has been pressed at a step S2. If the print button has not been pressed, the control portion 23*a* repeats this determination until the print button is pressed. When determining that the print button has been pressed at the step S2, the control portion 23*a* reads the image data 22 for printing at a step S3. At a step S4, the control portion 23*a* develops the read image data 22 on the RAM 23*h*, and thereafter converts the image data 22 from RGB data to CMY data. The RGB data is constituted of the three primary colors (R (red), G (green) and B (blue)) of light, while the CMY data is constituted of the three primary colors (C (cyan), M (magenta) and Y (yellow)) of color materials. At a step S5, the control portion 23*a* initializes the counter 23*i* provided thereon and sets the values, which are variables, of the lines (line) and the dots (i) to zero. At a step S6, the control portion 23*a* feeds the paper 14 from the paper feed cassette case 26 (see FIG. 1) toward a printing start position and determines whether or not the paper 14 has reached the printing start position.

In the operation of feeding the paper 14 at the step S6, the sheet search sensor 28 first recognizes the identification portion 25*j* provided on the head of the Y (yellow) printing sheet 25*f* (see FIG. 7), as shown in FIG. 12. Thus, the sheet search sensor 28 searches for the Y (yellow) printing sheet 25*f*. In this paper feed operation, the control portion 23*a* so drives the paper feed motor 15 that the motor gear 15*a* mounted thereon rotates along arrow C3 in FIG. 4, thereby rotating the feed roller gear 5 along arrow C1 in FIG. 4 through the intermediate gears 18 and 19. Following the rotation of the feed roller gear 5 along arrow C1 in FIG. 4, the paper feed roller gear 9 rotates along arrow C4 in FIG. 4 through the intermediate gears 20 and 21. Thus, the paper feed roller 8 rotates along arrow C4 in FIG. 12 following the rotation of the paper feed roller gear 9, thereby carrying the paper 14 in contact with the lower surface of the paper feed roller 8 in a paper feed direction (along arrow T1 in FIG. 12). Thereafter the lower paper guide 7*a* guides the paper 14 carried by the paper feed roller 8 to progress along the paper feed direction, so that the feed roller 4 and the press roller 6 carry the same to the printing start position.

As shown in FIG. 4, the swingable swing gear 17 swings to separate from the gear portion 12*a* of the take-up reel 12 (along arrow C2 in FIG. 4), not to mesh with the gear portion 12*a* of the take-up reel 12. Thus, the gear portion 12*a* of the take-up reel 12 remains unrotational in paper feeding, not to take up the ink sheet 25*e* wound on the take-up bobbin 25*c* and the feed bobbin 25*d*.

According to this embodiment, the heating elements 2*d* of the print head 2 press the margin 14*b* of the paper 14 separated from the print area 14*a* by 10 lines on the printing start position.

At a step S7, the control portion 23*a* drives the print head rotating motor 16 through the motor driver 23*c* and the motor controller 23*d*. Following this driving of the print head rotating motor 16, the head portion 2*b* of the print head 2 rotates toward the platen roller 3. Thus, the heating elements 2*d* of the print head 2 press the platen roller 3 through the ink sheet 25*e* and the paper 14. At this time, the heating elements 2*d* of the print head 2 press the margin 14*b* of the paper 14 separated from the print area 14*a* by 10 lines. At a step S8, the temperature sensor chip 29 detects the temperature around the heating elements 2*d* as an analog voltage value. The A-D conversion portion 23*e* converts the detected analog voltage value to digital temperature data.

At a step S9, the control portion 23*a* performs a line printing subroutine. In this line printing subroutine at the step S9, the control portion 23*a* increases the temperatures of the heating elements 2*d* of the print head 2 to about 30° C., i.e., a level proper for starting printing beforehand, and thereafter performs normal printing. More specifically, the control portion 23*a* applies the voltage pulse to the heating elements 2*d* of the print head 2 while freely running (carrying) the paper 14 for 10 lines from a line A to a line B in FIG. 9 after the heating elements 2*d* of the print head 2 press the platen roller 3 on the line A in FIG. 9 and before starting the printing. Thereafter the control portion 23*a* performs normal printing from the print area 14*a* (line B in FIG. 9) of the paper 14.

In the normal printing, the motor gear 15*a* mounted on the paper feed motor 15 rotates along arrow D3 in FIG. 4 following driving of the paper feed motor 15, so that the feed roller gear 5 rotates along arrow D1 in FIG. 4 through the intermediate gears 18 and 19. Thus, the feed roller 4 rotates along arrow D1 in FIG. 13 following the rotation of the feed roller gear 5 along arrow D1 in FIG. 4, for carrying the paper 14 in the paper discharge direction (along arrow U1 in FIG. 13). The swingable swing gear 17 swings along arrow D2 in FIG. 4, to mesh with the gear 12*a* of the take-up reel 12. Thus, the gear portion 12*a* of the take-up reel 12 rotates along arrow D4 in FIG. 4, for taking up the ink sheet 25*e* wound on the take-up bobbin 25*c* and the feed bobbin 25*d*.

At this time, the print head 2 rotates toward the platen roller 3 through the gears 16*a* and 16*b* (see FIG. 5) following driving of the print head rotating motor 16, so that the heating elements 2*d* press the platen roller 3 through the ink sheet 25*e* and the paper 14. The control potion 23*a* prints the ink from the Y (yellow) printing sheet 25*f* on the paper 14 with the heating elements 2*d* of the print head 2 while carrying the paper 14 in the paper discharge direction (along arrow U1 in FIG. 13) and taking up the ink sheet 25*e*. When the control portion 23*a* completely prints the ink from the Y (yellow) printing sheet 25*f*, the upper paper guide 7*b* guides the paper 14 to a position carriable by the paper discharge roller 10, as shown in FIG. 14.

Figure 13:
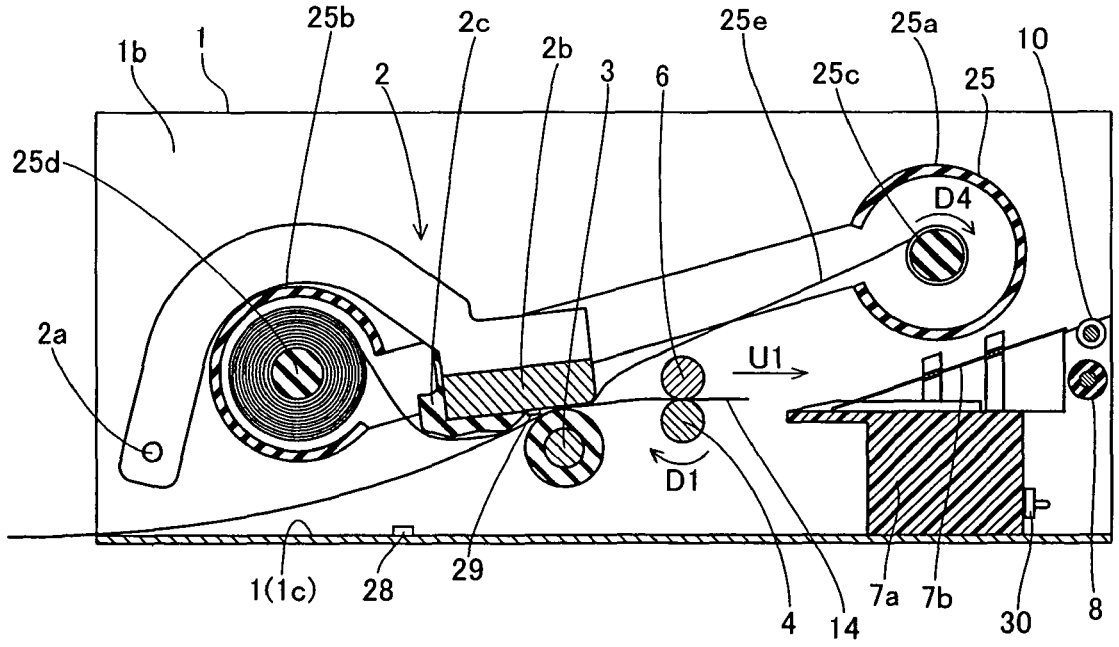

Then, the control portion 23*a* drives the print head rotating motor 16 to rotate the head portion 2*b* of the print head 2 in a direction for separating from the platen roller 3. Further, the sheet search sensor 28 recognizes the identification portion 25*j* provided on the head of the M (magenta) printing sheet 25*g*, thereby searching for the M (magenta) printing sheet 25*g*. Following driving of the paper feed motor 15, the motor gear 15*a* mounted thereon rotates along arrow C3 in FIG. 4 to rotate the feed roller gear 5 along arrow C1 in FIG. 4 through the intermediate gears 18 and 19. Thus, the feed roller 4 rotates along arrow C1 as shown in FIG. 13, so that the feed roller 4 and the press roller 6 carry the paper 14 to the printing start position. Then, the control portion 23*a* operates similarly to the above, for printing the ink from the M (magenta) printing sheet 25*g* on the paper 14. Thereafter the control portion 23*a* prints the ink from the C (cyan) printing sheet 25*h* and the transparent OP (overcoat) sheet 25*i* on the paper 14 similarly to the above, and completes the printing on the paper 14.

Figure 14:
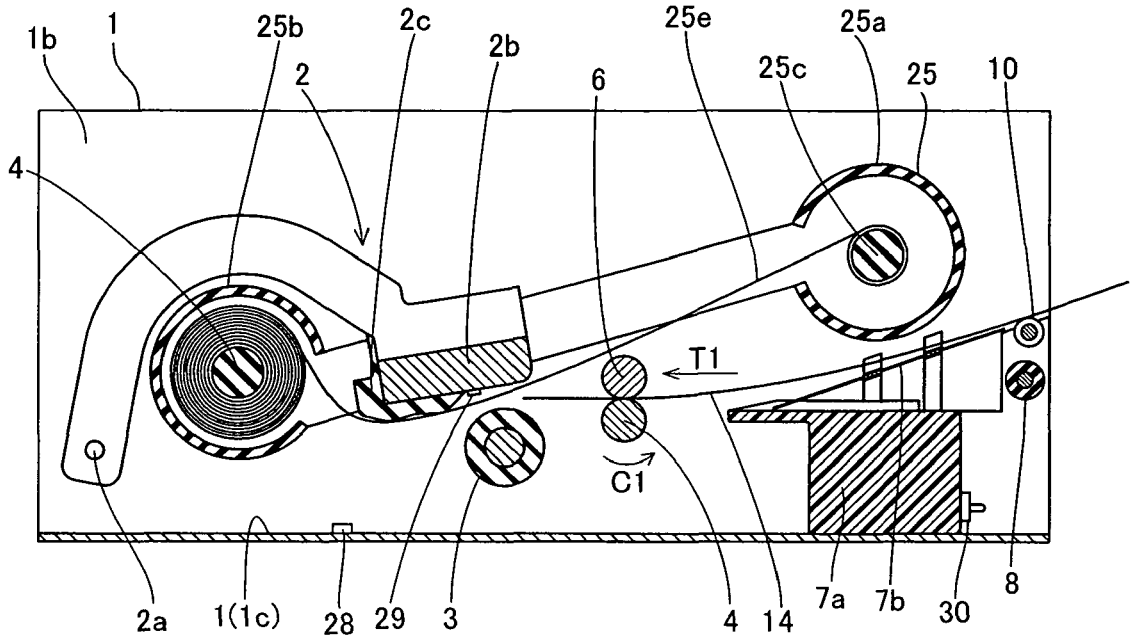

In paper discharge, the upper paper guide 7*b* guides the completely printed paper 14 so that the paper discharge roller 10 discharges the same, as shown in FIG. 14. At this time, the paper feed motor 15 and the respective gears operate similarly to the aforementioned case of carrying the paper 14 in the paper discharge direction (along arrow U1 in FIG. 13) in printing.

In the aforementioned normal printing, the control portion 23*a* determines whether or not all lines (1810 lines) of the paper 14 have been completely printed at a step S10. The number of the lines is 1810 in total since the print area 14*a* of the paper 14 has the 1800 lines while the control portion 23*a* freely runs the paper 14 for 10 lines through the margin 14*b*, as shown in FIG. 11. When determining that all lines of the paper 14 have not yet been completely printed at the step S10, the control portion 23*a* returns to the step S9 for the line printing subroutine. When determining that all lines (1810 lines) of the paper 14 have been completely printed at the step S10, on the other hand, the control portion 23*a* determines whether or not the color printing sheets 25*f* to 25*h* have been completely printed. If only the Y (yellow) printing sheet 25*f* has been completely printed, the control portion 23*a* determines that the color printing sheets 25*f* to 25*h* have not yet been completely printed, and repeats the printing operation at the steps S5 to S11 in order of the M (magenta) and C (cyan) printing sheets 25*g* and 25*h*. When determining that the color printing sheets 25*f* to 25*h* have been completely printed at the step S11, the control portion 23*a* determines whether or not the C (cyan) printing sheet 25*h* has been completely printed at a step S12. The control portion 23*a* repeats the printing operation at the steps S5 to S12 when determining that the C (cyan) printing sheet 25*h* has not yet been completely printed at the step S12, while advancing to a step S13 when determining that the C (cyan) printing sheet 25*h* has been completely printed at the step S12, for transferring the OP (overcoat) sheet 25*i* for protecting the ink transferred to the paper 14. When completely transferring the OP sheet 25*i*, the control portion 23*a* feeds the paper 14 and the ink sheet 25*e* in the paper discharge direction (along arrow U1 in FIG. 13) similarly to the aforementioned paper discharge operation, and turns off the power supply portion 24 at a step S14 for completing the printing operation on the paper 14.

Figure 15:
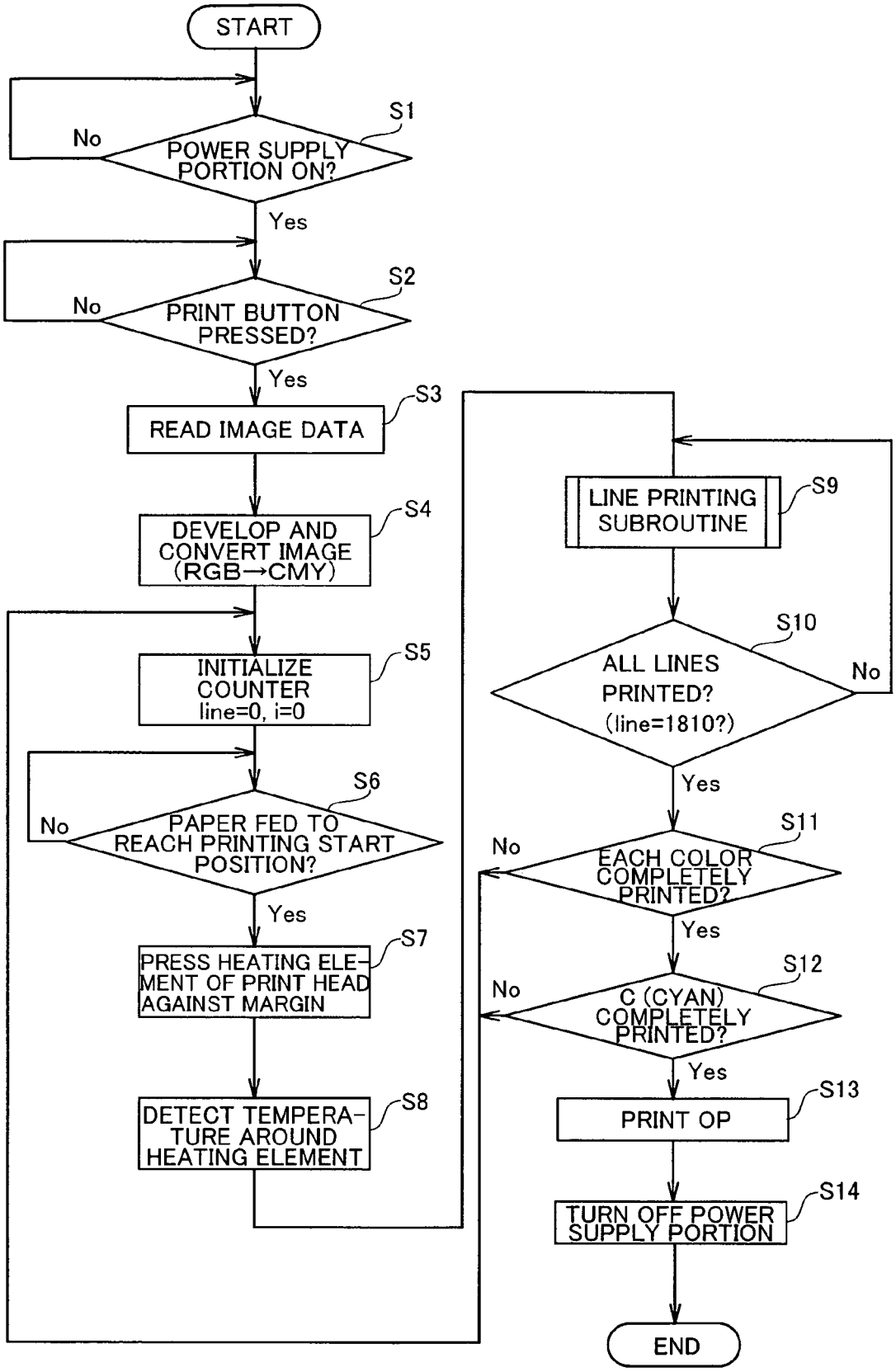
FIG. 15 is a flow chart for illustrating a printing operation of the thermal transfer printer according to the embodiment of the present invention shown in FIG. 1.
Figure 16:
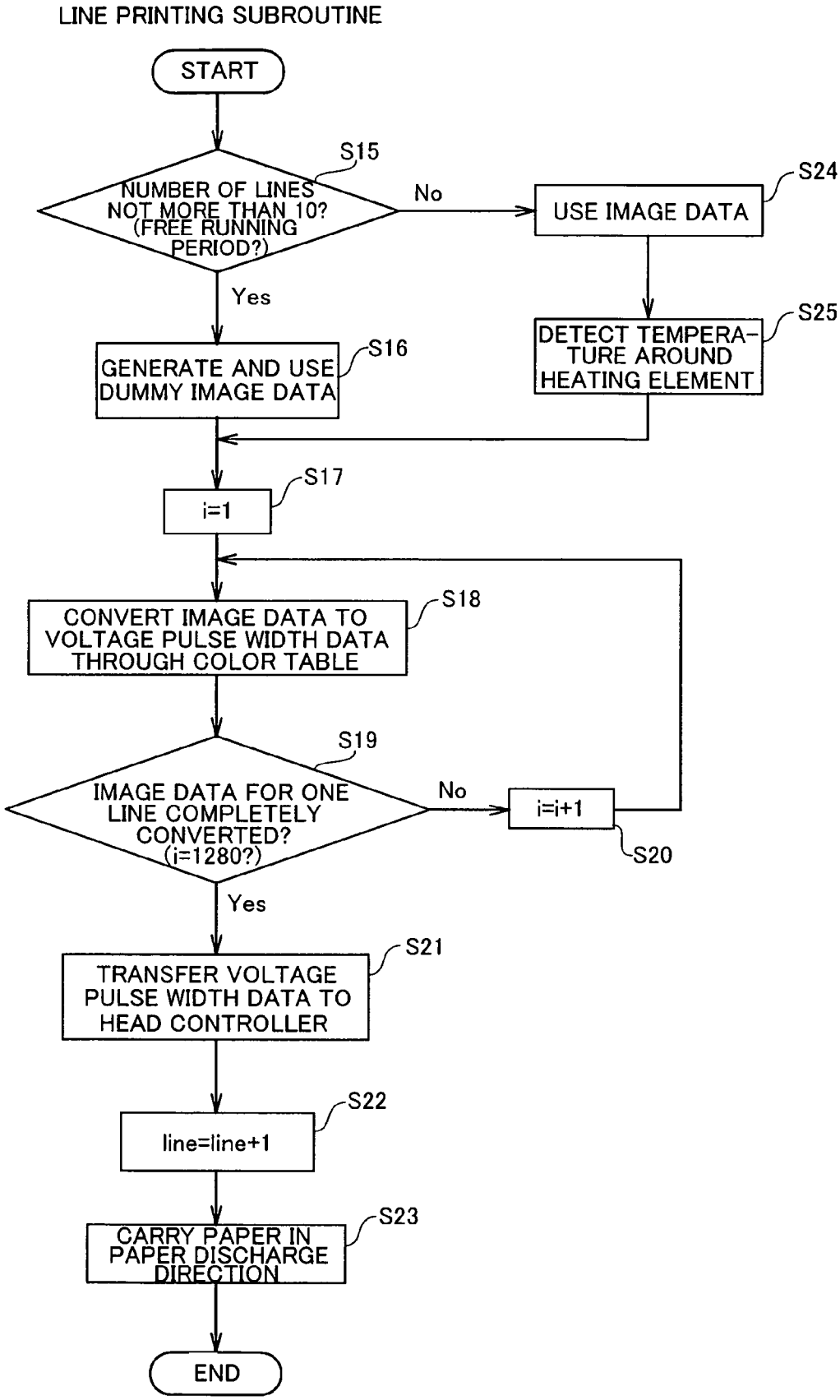
FIG. 16 is a flow chart for illustrating operations in a line printing subroutine at a step S9 shown in FIG. 15.

The line printing subroutine at the step S9 shown in FIG. 15 is now described in detail with reference to FIGS. 3, 8 to 10, 13 and 16. First, the control portion 23*a* determines whether or not the number of lines (line) counted by the counter 23*i* is not more than 10 (whether or not in a free running period) at a step S15. When determining that the number of lines (line) is not more than 10 (in a free running period), the thermal transfer printer is in a state before starting printing, and the control portion 23*a* generates and uses dummy image data 22 as data converted to voltage pulse width data at a step S16. The color table 23*f* converts the dummy image data 22 of a gradation zero to voltage pulse width data of a gradation zero.

At a step S17, the control portion 23*a* sets the number of dots (i) to 1. At a step S18, the control portion 23*a* converts dots of image data 22 having an i-th dot number to voltage pulse width data.

According to this embodiment, the control portion 23*a* develops the color table 23*f* (see FIG. 8) previously stored in the ROM 23*g* on the RAM 23*h* and converts the dots of the image data 22 having the i-th dot number to the voltage pulse width data through the data of the gradation zero of each of the printing sheets 25*f* to 25*h* at a temperature corresponding to the temperature around the heating elements 2*d* detected at the step S8 if the number of lines (line) counted by the counter 23*i* thereof is not more than 10.

At a step S19, the control portion 23*a* determines whether or not image data 22 for one line (1280 dots) has been converted to voltage pulse width data. When determining that the image data 22 for one line (1280 dots) has not yet been converted to voltage pulse width data at the step S19, the control portion 23*a* sets the dots of the i-th dot number to a subsequent (i+1)-th dot. At the step S18, the control portion 23*a* converts the dots of (i+1)-th image data 22 to voltage pulse width data through the color table 23*f*. The control portion 23*a* repeats this operation until the number of dots (i) reaches 1280.

When determining that the image data 22 for one line (1280 dots) has been converted to voltage pulse width data at the step S19, on the other hand, the control portion 23*a* transfers the voltage pulse width data for one line (1280 dots) to the head controller 23*b* at a step S21. Then, the head controller 23*b* applies the voltage pulse of the gradation zero having the converted voltage pulse width to the heating elements 2*d* of the print head 2. At a step S22, the control portion 23*a* sets a next line number, and carries the paper 14 in the paper discharge direction (along arrow U1 in FIG. 13) by one line similarly to the aforementioned paper discharge operation at a step S23. The control portion 23*a*, performing the line printing subroutine at the step S9 at a high speed, substantially simultaneously carries the paper 14 in the paper discharge direction and applies the voltage pulse to the heating elements 2*d*. Then, the control portion 23*a* completes the line printing subroutine at the step S9.

According to this embodiment, the control portion 23*a*, freely running the paper 14 for 10 lines before starting the printing as shown in FIG. 9, repeats the aforementioned steps S15 to S23 until the number of lines reaches 10. When the heating elements 2*d* of the print head 2 are positioned on the margin 14*b* of the paper 14 as shown in FIG. 9, the control portion 23*a* increases the temperatures of the heating elements 2*d* to the level optimum for starting the printing by applying the voltage pulse data of the gradation zero to the heating elements 2*d* while carrying the paper 14.

When determining that the number of lines is at least 10 (not in free running) at the step S15, on the other hand, the control portion 23*a* performs the normal printing. More specifically, the control portion 23*a* uses image data 22 as the data converted to voltage pulse width data at a step S24. At the step S25, the temperature sensor chip 29 detects the temperature around the heating elements 2*d* as a voltage value, so that the A-D conversion portion 23*e* converts the detected voltage value from an analog value to a digital value utilized as temperature data.

At a step S17, the control portion 23*a* sets the number of dots (i) to 1. At a step S18, the control portion 23*a* converts the dots of i-th image data 22 to voltage pulse width data through the color table 23*f*. The color table 23*f* stores the temperature corresponding to that around the heating elements 2*d* obtained at the step S25 and the voltage pulse width (relative value) corresponding to each gradation of each of the Y, M and C printing sheets 25*f*, 25*g* and 25*h*. When the temperature around the heating elements 2*d* is 60° C. and image data 22 of the Y printing sheet 25*f* has the gradation 2, for example, the control portion 23*a* decides the voltage pulse width (relative value) as "50" and converts the image data 22 to voltage pulse width data of this value, as show in FIG. 8.

At a step S19, the control portion 23*a* determines whether or not image data 22 for one line (1280 dots) has been converted to voltage pulse width data. When determining that the image data 22 for one line (1280 dots) has not yet been converted to voltage pulse width data at the step S19, the control portion 23*a* sets the dots of the i-th dot number to a subsequent (i+1)-th dot at a step S20. At the step S18, the control portion 23*a* converts the dots of (i+1)-th image data 22 to voltage pulse width data through the color table 23*f*. The control portion 23*a* repeats this operation until the number of dots (i) reaches 1280.

When determining that the image data 22 for one line (1280 dots) has been converted to voltage pulse width data at the step S19, on the other hand, the control portion 23*a* transfers the voltage pulse width data for one line (1280 dots) to the head controller 23*b* (see FIG. 3) at the step S21. Then, the head controller 23*b* applies the voltage pulse with the converted voltage pulse width to the heating elements 2*d* of the print head 2. The temperatures of the heating elements 2*d* of the print head 2 receiving the voltage pulse are increased due to resistance thereof, to melt the ink of the ink sheet 25*e* as shown in FIG. 9. The melted ink is transferred to the receptive layer 14*d* (see FIG. 10) of the paper 14, for forming an image based on the image data 22.

The control portion 23*a* sets a next line number at the step S21, and carries the paper 14 in the paper discharge direction (along arrow U1 in FIG. 13) by one line similarly to the aforementioned paper discharge operation. Thus, the control portion 23*a* completes the line printing subroutine at the step S9.

Since the print area 14*a* of the paper 14 has the 1800 lines, the control portion 23*a* repeats the aforementioned operation of printing the Y printing sheet 25*f* until completely printing the same on the 1800 lines. When completely printing the Y printing sheet 25*f*, the control portion 23*a* feeds the paper 14 and the ink sheet 25*e* in the paper discharge direction (along arrow U1 in FIG. 13) while the print head 2 and the platen roller 3 are in contact with each other. Then, the control portion 23*a* repeats the aforementioned operation on the M and C printing sheets 25*g* and 25*h* and the OP sheet 25*i*.

According to this embodiment, as hereinabove described, the thermal transfer printer, comprising the control portion 23*a* applying the prescribed voltage pulse to the heating elements 2*d* of the print head 2 after pressing the print head 2 against the platen roller 3 and before starting printing as hereinabove described, can increase the temperatures of the heating elements 2*d* of the print head 2 to the proper level for starting printing beforehand, whereby reduction of print density can be suppressed in an initial stage of printing.

According to this embodiment, further, the control portion 23*a* applies the prescribed voltage pulse to the heating elements 2*d* of the print head 2 while carrying the paper 14 for dispersing heat generated from the heating elements 2*d* to the paper 14 by carrying the paper 14, whereby the heat can be inhibited from locally remaining in the heating elements 2*d* dissimilarly to a case of applying the voltage pulse to the heating elements 2*d* of the print head 2 without carrying the paper 14. Therefore, the ink can be inhibited from adhering to the paper 14 also when the control portion 23*a* applies a voltage pulse higher than that locally leaving the heat in the heating elements 2*d*, whereby the time for increasing the temperatures of the heating elements 2*d* can be reduced by applying a high voltage pulse.

According to this embodiment, the paper 14 is so arranged that the heating elements 2*d* of the print head 2 press the margin 14*b* of the paper 14 separated from the print area 14*a* of the paper 14 by the prescribed distance when the print head 2 presses the platen roller 3 before starting the printing and the control portion 23*a* applies the prescribed voltage pulse to the heating elements 2*d* of the print head 2 while carrying the paper 14 from the position where the heating elements 2*d* of the print head 2 press the margin 14*b* to the position where the heating elements 2*d* press the print area 14*a* so that the temperatures of the heating elements 2*d* of the print head 2 can be increased to the proper level for starting printing while the paper 14 is carried from the position where the heating elements 2*d* of the print head 2 press the margin 14*b* to the position where the heating elements 2*d* press the print area 14*a*, whereby the heating elements 2*d* of the print head 2 are at the proper temperature when reaching the print area 14*a* of the paper 14. Thus, the thermal transfer printer can simultaneously start the printing when the heating elements 2*d* of the print head 2 reach the print area 14*a*, not to delay the start of printing.

According to this embodiment, the control portion 23*a* applies the voltage pulse to the heating elements 2*d* of the print head 2 while carrying the paper 14 after pressing the print head 2 against the platen roller 3 and before starting printing every color of the ink sheet 25*e*, whereby the thermal transfer printer, capable of increasing the temperatures of the heating elements 2*d* to the level proper for starting the printing every color of the ink sheet 25*e* beforehand, can easily suppress reduction of print density in the initial stage of printing and improve printing quality.

According to this embodiment, the control portion 23*a* applies the voltage pulse to the heating elements 2*d* of the print head 2 with a voltage pulse width corresponding to a prescribed gradation of the color table 23*f*, whereby the thermal transfer printer, capable of applying the voltage pulse to the heating elements 2*d* with the optimum voltage pulse application width based on the temperature of the print head 2, can precisely increase the temperatures of the heating elements 2*d* to the level proper for starting the printing beforehand.

According to this embodiment, the thermal transfer printer setting the voltage pulse width (relative value) of the gradation zero to the level shorter than the pulse width for printing (transferring) the ink from the ink sheet 25*e* on (to) the paper 14 can inhibit the ink from being printed on (transferred to) the paper 14 from the ink sheet 25*e* before starting the printing.

According to this embodiment, the thermal transfer printer, applying the voltage pulse on the basis of the dummy image data 22 while carrying the paper 14 before starting the printing, can apply the voltage pulse to the heating elements 2*d* of the print head 2 before starting printing in a method similar to that in the printing.

According to this embodiment, the temperature sensor chip 29 detects the temperature around the heating elements 2*d* of the print head 2 every line while the control portion 23*a* applies the voltage pulse to the heating elements 2*d* of the print head 2 for the time corresponding to the temperature detected by the temperature sensor chip 29 every line when the heating elements 2*d* of the print head 2 pass through the margin 14*b* and reach the print area 14*a* of the paper 14, whereby the thermal transfer printer, capable of controlling the temperatures of the heating elements 2*d* of the print head 2 every line in normal printing after the heating elements 2*d* pass through the margin 14*b*, can further improve the printing quality.

Although the present invention has been described and illustrated in detail, it is clearly understood that the same is by way of illustration and example only and is not to be taken by way of limitation, the spirit and scope of the present invention being limited only by the terms of the appended claims.

For example, while the paper is so arranged that the heating elements of the print head press the margin of the paper when the print head presses the platen roller in the aforementioned embodiment, the present invention is not restricted to this but the paper may alternatively be so arranged that the heating elements of the print head press the print area of the paper when the print head presses the platen roller.

While the thermal transfer printer applies the voltage pulse to the heating elements of the print head with the prescribed voltage pulse width while carrying the paper before starting the printing in each color of the Y, M and C color printing sheets of the ink sheet in the aforementioned embodiment, the present invention is not restricted to this but the thermal transfer printer may alternatively apply the voltage pulse to the heating elements of the print head with the prescribed voltage pulse width while carrying the paper only before starting printing in a prescribed one of the colors (Y, M and C) of the ink sheet. Further alternatively, the thermal transfer printer may apply the voltage pulse to the heating elements of the print head with the prescribed voltage pulse width while carrying the paper before starting transferring the OP (overcoat) sheet, similarly to the aforementioned case of each of the colors (Y, M and C).

While the thermal transfer printer applies the voltage pulse to the heating elements of the print head while carrying the paper by 10 lines before starting the printing in the aforementioned embodiment, the present invention is not restricted to this but the thermal transfer printer may alternatively carry the paper by a number of lines other than 10.

While the thermal transfer printer employs the voltage pulse width data of the gradation zero in the color table stored every temperature for applying the voltage pulse to the heating elements of the print head while carrying the paper in the aforementioned embodiment, the present invention is not restricted to this but a color table recording only the voltage pulse width data for applying the voltage pulse to the heating elements of the print head while carrying the paper after pressing the print head against the platen roller and before starting printing may alternatively be created for deciding the voltage pulse width through the created color table.

While the thermal transfer printer controls the energy supplied to the heating elements of the print head by controlling the width of the voltage pulse in the aforementioned embodiment, the present invention is not restricted to this but the thermal transfer printer may alternatively control the energy supplied to the heating elements by controlling a parameter (voltage value, for example) other than the width of the voltage pulse.

What is claimed is:

1. A printer comprising:

a print head having a heating element for printing an image on a paper by transferring ink of an ink sheet having a sheet of a plurality of colors to said paper;

a temperature detecting portion for detecting a temperature around said heating element of said print head;

a platen roller against which said print head is pressed through said ink sheet and said paper;

print head control means applying a prescribed voltage pulse to said heating element of said print head under an application condition determined on the basis of the temperature detected by said temperature detecting portion; and a color table provided in correspondence to every prescribed temperature of said print head for deciding an application time of said voltage pulse applied to said heating element of said print head, wherein said paper is so arranged that said heating element of said print head presses a margin of said paper separated from a print area of said paper by a prescribed distance when said print head presses said platen roller before starting said printing, said print head control means applies said prescribed voltage pulse to said heating element of said print head for an application time corresponding to the temperature detected by said temperature detecting portion and a prescribed gradation of said color table by a prescribed paper feed while carrying said paper from a position where said heating element of said print head presses said margin to a position where said heating element presses said print area after pressing said print head against said platen roller and before starting printing every said color of said ink sheet, the temperature detecting portion includes a temperature sensor chip for detecting the temperature around said heating element of said print head, and said print head control means applies said voltage pulse to said heating element of said print head by a plurality of lines for a time corresponding to the temperature detected by said temperature sensor chip while said heating element of said print head passes through said margin.

2. The printer according to claim 1, starting said printing by applying said prescribed voltage pulse to said heating element of said print head on the basis of image data for said printing when said heating element of said print head passes through said margin and reaches said print area of said paper.

3. The printer according to claim 1, wherein said color table includes a plurality of voltage pulse width data corresponding to said plurality of colors respectively, and said print head control means applies said voltage pulse to said heating element of said print head for a time corresponding to said voltage pulse width data of a gradation zero of each of said plurality of colors before starting said printing.

4. The printer according to claim 3, wherein said application time corresponding to said voltage pulse width data of said gradation zero is shorter than an application time for transferring said ink from said ink sheet to said paper.

5. The printer according to claim 1, wherein said print head control means applies said voltage pulse on the basis of dummy image data while carrying said paper before starting said printing.

6. The printer according to claim 1, wherein said temperature sensor chip detects the temperature around said heating element of said print head every said line while said print head control means applies said voltage pulse to said heating element of said print head for a time corresponding to the temperature detected by said temperature sensor chip every said line when said heating element of said print head passes through said margin and reaches said print area of said paper.

* * * * *